US010799731B2

(12) United States Patent
Jacob et al.

(10) Patent No.: US 10,799,731 B2
(45) Date of Patent: Oct. 13, 2020

(54) HARNESS WITH INTEGRATED ENERGY ABSORBER

(71) Applicant: MSA Technology, LLC, Cranberry Township, PA (US)

(72) Inventors: Matthew Frederick Jacob, Pittsburgh, PA (US); Benjamin T. Sepe, Pittsburgh, PA (US); Matthew Quigley, Pittsburgh, PA (US)

(73) Assignee: MSA Technology, LLC, Cranberry Township, PA (US)

( * ) Notice: Subject to any disclaimer, the term of this patent is extended or adjusted under 35 U.S.C. 154(b) by 0 days.

(21) Appl. No.: 15/376,233

(22) Filed: Dec. 12, 2016

(65) Prior Publication Data

US 2018/0161607 A1 Jun. 14, 2018

(51) Int. Cl.
*A62B 35/00* (2006.01)
*A62B 35/04* (2006.01)

(52) U.S. Cl.
CPC ..... *A62B 35/0025* (2013.01); *A62B 35/0018* (2013.01); *A62B 35/0037* (2013.01); *A62B 35/04* (2013.01)

(58) Field of Classification Search
CPC ..... E06C 7/003; A62B 35/04; A62B 35/0025
See application file for complete search history.

(56) References Cited

U.S. PATENT DOCUMENTS 1,574,672 A * 2/1926 McCarroll-Doull ..... A47D 15/006 128/875
3,176,793 A 4/1965 Hlacia
3,444,957 A * 5/1969 Gilpin, Jr. ..... F16F 7/00 182/3
4,512,437 A 4/1985 Savage
4,518,026 A 5/1985 Otto et al.
4,712,513 A 12/1987 Huppertsberg
5,113,981 A * 5/1992 Lantz ..... F16F 7/006 182/3
5,167,263 A * 12/1992 Kelen ..... D03D 15/00 139/22

(Continued)

FOREIGN PATENT DOCUMENTS

EP 2724752 B1 4/2014
WO 2007134746 A1 11/2007

OTHER PUBLICATIONS

American Heritage® Dictionary of the English Language, Fifth Edition. Copyright ® 2016 by Houghton Mifflin Harcourt Publishing Company. Published by Houghton Mifflin Harcourt Publishing Company. All rights reserved. (Year: 2019).*

(Continued)

*Primary Examiner* — Katherine W Mitchell
*Assistant Examiner* — Candace L Bradford
(74) *Attorney, Agent, or Firm* — The Webb Law Firm

(57) ABSTRACT

A fall protection harness for being removably worn by a user having at least two leg straps, a first shoulder strap and a second shoulder strap. At least one of the shoulder straps has an energy absorbing element integrated therewith. The energy absorbing element may be a tubular webbing material surrounding a tearable webbing material with at least two bound webbing components configured to tear from one another when the shoulder strap is subjected to a force that exceeds a predetermined threshold.

15 Claims, 4 Drawing Sheets

(56) References Cited

U.S. PATENT DOCUMENTS 5,279,386 A * 1/1994 Cearley ..... A62B 35/0031 119/907
5,287,943 A 2/1994 Bell
6,006,860 A * 12/1999 Bell ..... A62B 35/04 182/18
6,085,802 A * 7/2000 Silberberg ..... A62B 35/04 139/387 R
6,299,040 B1 * 10/2001 Matias ..... A45F 5/00 224/254
6,374,946 B1 4/2002 Petzl et al.
6,874,596 B2 4/2005 Zeissler et al.
7,331,363 B2 * 2/2008 Lanzi ..... D03D 11/02 139/22
7,662,575 B2 2/2010 Sikora et al.
7,726,350 B2 * 6/2010 Jennings ..... A62B 35/04 139/383 B
8,356,691 B2 * 1/2013 Griffith ..... A62B 35/04 182/18
8,584,799 B1 * 11/2013 Dennington ..... A62B 35/04 182/3
8,651,235 B2 * 2/2014 Wood ..... A62B 1/14 182/191
8,959,664 B2 * 2/2015 Johnson ..... A62B 35/0025 2/44
8,967,600 B2 * 3/2015 Hede ..... A62B 35/0075 139/384 R
8,997,317 B2 * 4/2015 Rinklake ..... A62B 35/04 24/300
9,027,707 B2 5/2015 Schierenbeck
9,174,073 B2 * 11/2015 Casebolt ..... A62B 35/0037
9,233,585 B1 * 1/2016 Haynes ..... B60D 1/18
9,308,402 B2 * 4/2016 Chevalier ..... A62B 35/00
9,387,350 B2 7/2016 Gopfert et al.
9,410,766 B1 * 8/2016 Falla ..... F41C 33/002
9,808,659 B2 11/2017 Chevalier
2005/0189169 A1 * 9/2005 Tanaka ..... D03D 11/02 182/3
2005/0269153 A1 * 12/2005 Casebolt ..... A62B 35/0093 182/3
2006/0048723 A1 * 3/2006 Rohlf ..... A62B 35/04 119/857
2006/0102423 A1 * 5/2006 Lang ..... A62B 35/04 182/36
2006/0169534 A1 8/2006 Green
2007/0023231 A1 2/2007 Gorman et al.
2007/0209868 A1 * 9/2007 Betcher ..... A62B 35/0025 182/3
2009/0057360 A1 * 3/2009 Demsky ..... A45F 3/047 224/262
2009/0071750 A1 3/2009 Simard et al.
2010/0025148 A1 2/2010 Dawson
2011/0186603 A1 * 8/2011 Alford ..... F41C 33/002 224/150
2013/0105246 A1 * 5/2013 Schlangen ..... F16F 7/006 182/241
2013/0292219 A1 * 11/2013 Perner ..... F16F 7/006 188/376

OTHER PUBLICATIONS

Office Action re U.S. Appl. No. 15/376,191 dated Dec. 11, 2019.

* cited by examiner

HARNESS WITH INTEGRATED ENERGY ABSORBER

BACKGROUND OF THE INVENTION

Field of the Invention

The present invention relates generally to a fall protection harness and, in particular, to a fall protection harness having an integrated energy absorber.

Description of the Related Art

As is known in the art, there exist various safety devices and arrangements that can be worn by or attached to a user to ensure the wearer's safety in certain situations. Such mechanisms come in many forms, including, but not limited to, harnesses and safety belts. Full body harnesses are widely used for lifting and lowering individuals in dangerous situations and as a primary component in a personal fall arrest system. These harnesses can also be used for work positioning, travel restriction, ladder climbing, rescue retrieval, and evacuation. While these harnesses are used mainly in an industrial setting, and particularly the construction industry where the likelihood and danger of falls from heights is both numerous and significant, a full body harness can be used in various other applications in which total suspension and support of the body must be ensured, either expectedly or unexpectedly.

While there are many variations in full body harness construction, all typically include a plurality of elongate straps that are combined together to fit around a user's body. In some embodiments or aspects, a full body harness may have an attachment point (D-ring) typically positioned in a central portion of the user's back, and a plurality of straps routed around predetermined portions of the user's body in such a manner as to hold or suspend the user in the event of a fall.

Full body harnesses, when used in a personal fall arrest system, must always be used with an energy absorbing element. In some embodiments or aspects, the energy absorbing element may be a self-retracting lanyard (SRL), and in other embodiments or aspects may include a lanyard or a rope grab. The SRL is attached at one end to an anchor point and at its other end to a line directly connected to the user. The SRL is configured to activate once the user has begun to fall to arrest the fall soon enough to prevent injury to the user. Typically, an SRL has a housing with a rotatable drum having a line wound about the drum and a braking mechanism for controlling the rotation of the drum. The drum can rotate in a first direction to unwind (or "pay out") the line from the housing when a certain level of tension is deliberately applied. When tension is reduced or released, the drum can slowly rotate in a reverse direction, thereby causing the line to retract or rewind onto the drum. The braking mechanism is configured for slowing down and stopping the rotation of the drum when the line unwinds too rapidly. For example, the braking mechanism may be activated to brake the rotation of the drum when the rotation speed exceeds a predetermined velocity. A sudden line pay out at a speed that exceeds normal payout is an indication that the user has experienced a fall that needs to be stopped or arrested. Should such an unintentional, accidental fall commence, the braking mechanism in the housing of the SRL is configured to engage and stop the user from falling too far.

Many falls occur over the edge of a working surface, causing the line of the SRL to bend over the edge. In such situations, the line is not moved relative to the edge, thereby imparting the entire force of a fall on a single point in the line at the edge. If an energy absorbing element is not positioned between the user and the edge, there is a risk that the user will be exposed to dangerously high forces caused by a sudden deceleration of the user's body as the user's weight is supported by the harness and a line attaching the user to the anchor point. Some full body harnesses have an energy absorbing element permanently attached to the D-ring on the user's back. This design. however, is often bulky and can interfere with the user's mobility. It also adds additional weight that the user must carry at all times.

Accordingly, there is a need in the art for an improved harness that addresses certain drawbacks and deficiencies associated with known harnesses. For example, there is a need for an improved harness with an improved energy absorbing element associated with the harness. There is a further need in the art for an improved harness that can be easily and effectively worn by the user in a variety of work environments without compromising the user's ability to move and without adding additional weight that must be borne by the user. There is also a need for an improved harness with increased safety compliance at the worksite, and with more effective and safe support of the user in the event of a fall.

SUMMARY OF THE INVENTION

Generally, provided is an improved fall protection harness having an integrated energy absorbing element. Preferably, provided is an improved harness having an energy absorbing element, such as a tearable webbing material. Preferably, provided is an improved harness that can be easily and effectively worn by the user in a variety of work environments without compromising the user's ability to move and without adding significant weight that must be borne by the user. Preferably, provided is an improved harness that not only leads to increased safety compliance at the worksite, but also provides increased effectiveness to the personal fall protection system and a resulting increase in the safety of the user in the event of a fall.

In some preferred and non-limiting embodiments or aspects, provided is a wearable harness having a plurality of straps, optionally including a first leg strap and a second leg strap, each leg strap having a first end and a second end removably attached to each other and configured to be free floating when detached from each other. The harness may optionally further include a belt strap having a first end and a second end removably attached to each other and configured to be free floating when detached from each other. The harness includes a shoulder strap having a first shoulder strap, and a second shoulder strap. One or both of the first shoulder strap and the second shoulder strap may have an energy absorbing element integrated therewith. The energy absorbing element may have a tubular webbing encasing a tearable webbing material with at least two bound (e.g., load-bearing) webbing components configured to tear from one another when the shoulder strap is subjected to a force that exceeds a predetermined threshold. Accordingly, the energy absorbing element may be integrated on or with at least a portion of at least one of the shoulder straps.

In other preferred and non-limiting embodiments or aspects, the energy absorbing element may be exposed from the tubular webbing at a substantially intermediate portion of at least one of the first shoulder strap and the second shoulder strap between the first end and the second end of the at least one of the first shoulder strap and the second shoulder strap. The energy absorbing element may be exposed from the tubular webbing through an opening in the tubular webbing. The opening may be a slit formed at a substantially intermediate portion of at least one of the first shoulder strap and the second shoulder strap between the first end and the second end of the at least one of the first shoulder strap and the second shoulder strap. At least a portion of the energy absorbing element may be configured to exit through the opening of the tubular webbing upon tearing. The tubular webbing may be made from a woven tubular material. The tubular webbing may be made from a substantially flat webbing material having opposing lateral ends connected to one another to define a tubular shape.

In other preferred and non-limiting embodiments or aspects, the at least two bound webbing components may be bound by a plurality of binder threads or an adhesive. The plurality of binder threads may be configured to tear successively in a longitudinal direction of at least one of the first shoulder strap and the second shoulder strap when the at least one of the first shoulder strap and the second shoulder strap is subject to the force that exceeds the predetermined threshold. The plurality of binder threads may extend through at least a portion of a thickness of the at least two webbing components. The plurality of binder threads may be arranged in a row, or two or more rows extending along a longitudinal length or a lateral length of the webbing components. The rows may be substantially parallel to each other or intersect with each other at least once over the longitudinal length or the lateral length of the webbing components. The plurality of binder threads may be arranged in two or more thread groups spaced apart from each other along a longitudinal length or a lateral length of the webbing components. The two or more thread groups may be arranged in a pattern. A density of the plurality of binder threads may increase from the rear portion to the front portion of the shoulder strap, or vice versa. The predetermined threshold may be in the range of about 310 lbs to about 2,250 lbs. The first shoulder strap and the second shoulder strap may have a starting tear area at the rear portion where the pair of bound webbing components is unbound. The first shoulder strap and the second shoulder strap may have an ending tear point having a reinforced area configured to prevent separation of the at least two bound webbing components. The energy absorbing element may be located on an energy absorbing area at the rear portion of at least one of the first shoulder strap and the second shoulder strap.

In other preferred and non-limiting embodiments or aspects, at least one connector may be arranged on at least one of the plurality of straps and configured to facilitate removable attachment of the free floating ends of at least one of the plurality of straps. The connector may be at least one of the following: a clip, a buckle, a mating arrangement, an attachment structure, or any combination thereof. The first end of each leg strap may be adjustably attached to the second end by a connection mechanism that can adjust the length of each leg strap. The harness may have a chest strap having a first end and a second end removably attached to each other and configured to be free floating when detached from each other. The first end of the chest strap may be attached to the first shoulder strap and the second end of the chest strap may be attached to the second shoulder strap. The harness may have a back strap connecting a rear portion of at least one of the first shoulder strap and the second shoulder strap.

In other preferred and non-limiting embodiments or aspects, a fall protection harness removably wearable by a user may have a plurality of straps, including an optional first leg strap, an optional second leg strap, and an optional belt strap. The fall protection harness includes a first shoulder strap and a second shoulder strap. One or both of the first shoulder strap and the second shoulder strap may have an energy absorbing element integrated therewith, the energy absorbing element comprising a tubular webbing encasing a tearable webbing material with at least two bound webbing components bound together by a plurality of binder threads configured to tear successively in a longitudinal direction of the first shoulder strap and the second shoulder strap when the first shoulder strap and the second shoulder strap are subjected to a predetermined force. The energy absorbing element may be exposed from the tubular webbing at a substantially intermediate portion of at least one of the first shoulder strap and the second shoulder strap between the first end and the second end of the at least one of the first shoulder strap and the second shoulder strap.

In other preferred and non-limiting embodiments or aspects, the first shoulder strap and the second shoulder strap may have a starting tear area at the rear portion where the pair of bound webbing components is unbound. The energy absorbing element may be located on an area at the rear portion of at least one of the first shoulder strap and the second shoulder strap. At least one connector may be arranged on at least one of the plurality of straps and configured to facilitate removable attachment of free floating ends of at least one of the plurality of straps. The connector may be at least one of the following: a clip, a buckle, a mating arrangement, an actuatable structure; or any combination thereof. The first end of each leg strap may be adjustably attached to the second end by a connection mechanism to adjust a length of each leg strap. The harness may have a chest strap having a first end and a second end removably attached to each other and configured to be free floating when detached from each other. The first end of the chest strap may be attached to the first shoulder strap and the second end of the chest strap may be attached to the second shoulder strap.

In other preferred and non-limiting embodiments or aspects, at least one strap of a harness may have a shoulder strap having tubular webbing encasing an energy absorbing element having a tearable webbing material with at least two bound webbing components bound together by a plurality of binder threads configured to tear successively in a longitudinal direction of the shoulder strap when the shoulder strap is subjected to a predetermined force. The energy absorbing element may be exposed from the tubular webbing at a substantially intermediate portion of the shoulder strap. In a harness removably attachable to a body of a user, at least one strap may have an energy absorbing element integrated with the at least one strap.

Further preferred and non-limiting embodiments or aspects will now be set forth in the following numbered clauses.

Clause 1: A wearable harness having a plurality of straps comprising: an optional first leg strap, an optional second leg strap, an optional belt strap, a first shoulder strap, and a second shoulder strap, wherein at least one of the first shoulder strap and the second shoulder strap comprises an energy absorbing element integrated therewith.

Clause 2: The harness of claim 1, wherein the energy absorbing element is a tubular webbing encasing a tearable webbing material with at least two bound webbing components configured to tear from one another when the shoulder strap is subjected to a force that exceeds a predetermined threshold.

Clause 3: The harness of clause 1 or 2, wherein the energy absorbing element is exposed from the tubular webbing at a substantially intermediate portion of at least one of the first shoulder strap and the second shoulder strap between the first end and the second end of the at least one of the first shoulder strap and the second shoulder strap.

Clause 4: The harness of any of clauses 1-3, wherein the energy absorbing element is exposed from the tubular webbing through an opening in the tubular webbing.

Clause 5: The harness of any of clauses 1-4, wherein at least a portion of the energy absorbing element is configured to exit through the opening of the tubular webbing upon tearing.

Clause 6: The harness of any of clauses 1-5, wherein the tubular webbing comprises a substantially flat webbing material having opposing lateral ends connected to one another to define a tubular shape.

Clause 7: The harness of any of clauses 1-6, wherein the at least two bound webbing components are bound by a plurality of binder threads.

Clause 8: The harness of any of clauses 1-7, wherein the plurality of binder threads are configured to tear successively in a longitudinal direction of at least one of the first shoulder strap and the second shoulder strap when the at least one of the first shoulder strap and the second shoulder strap is subjected to the force that exceeds the predetermined threshold.

Clause 9: The harness of any of clauses 1-8, wherein the plurality of binder threads extend through at least a portion of a thickness of the at least two webbing components.

Clause 10: The harness of any of clauses 1-9, wherein the plurality of binder threads are arranged in two or more substantially parallel or intersecting rows extending along a longitudinal length or a lateral length of the webbing components.

Clause 11: The harness of any of clauses 1-10, wherein the plurality of binder threads are arranged in two or more thread groups spaced apart from each other along a longitudinal length or a lateral length of the webbing components.

Clause 12: The harness of any of clauses 1-11, wherein the predetermined threshold is about 310 lbs to about 2,250 lbs.

Clause 13: The harness of any of clauses 1-12, wherein the at least two bound webbing components are bound together by an adhesive.

Clause 14: The harness of any of clauses 1-13, wherein the first shoulder strap and the second shoulder strap have a starting tear area at a rear portion where the pair of bound webbing components is unbound.

Clause 15: The harness of any of clauses 1-14, wherein the first shoulder strap and the second shoulder strap have an ending tear point having a reinforced area configured to prevent separation of the at least two bound webbing components.

Clause 16. The harness of any of clauses 1-15, wherein the energy absorbing element is located on an area at a rear portion of at least one of the first shoulder strap and the second shoulder strap.

Clause 17: A fall protection harness removably wearable by a user, the harness having a plurality of straps comprising: an optional first leg strap an optional second leg strap, an optional belt strap, a first shoulder strap, and a second shoulder strap, wherein at least one of the first shoulder strap and the second shoulder strap have an energy absorbing element integrated therewith, the energy absorbing element comprising a tubular webbing encasing a tearable webbing material with at least two bound webbing components bound together by a plurality of binder threads configured to tear successively in a longitudinal direction of the first shoulder strap and the second shoulder strap when the first shoulder strap and the second shoulder strap are subjected to a predetermined force, and wherein the energy absorbing element is exposed from the tubular webbing at a substantially intermediate portion of at least one of the first shoulder strap and the second shoulder strap between the first end and the second end of the at least one of the first shoulder strap and the second shoulder strap.

Clause 18: The harness of clause 17, wherein the first end of each leg strap is adjustably attached to the second end by a connection mechanism to adjust a length of each leg strap.

Clause 19: The harness of clause 17 or clause 18, wherein the energy absorbing element is located on an area at a rear portion of at least one of the first shoulder strap and the second shoulder strap.

Clause 20: In a harness removably attachable to a body of a user and having at least one strap comprising an energy absorbing element integrated with the at least one strap.

These and other features and characteristics of the present disclosure, as well as the methods of operation and functions of the related elements of structures and the combination of parts and economies of manufacture, will become more apparent upon consideration of the following description and the appended claims with reference to the accompanying drawings, all of which form a part of this specification, wherein like reference numerals designate corresponding parts in the various figures. It is to be expressly understood, however, that the drawings are for the purpose of illustration and description only and are not intended as a definition of the limits of the invention.

DETAILED DESCRIPTION OF THE PREFERRED EMBODIMENTS

Figure 1:
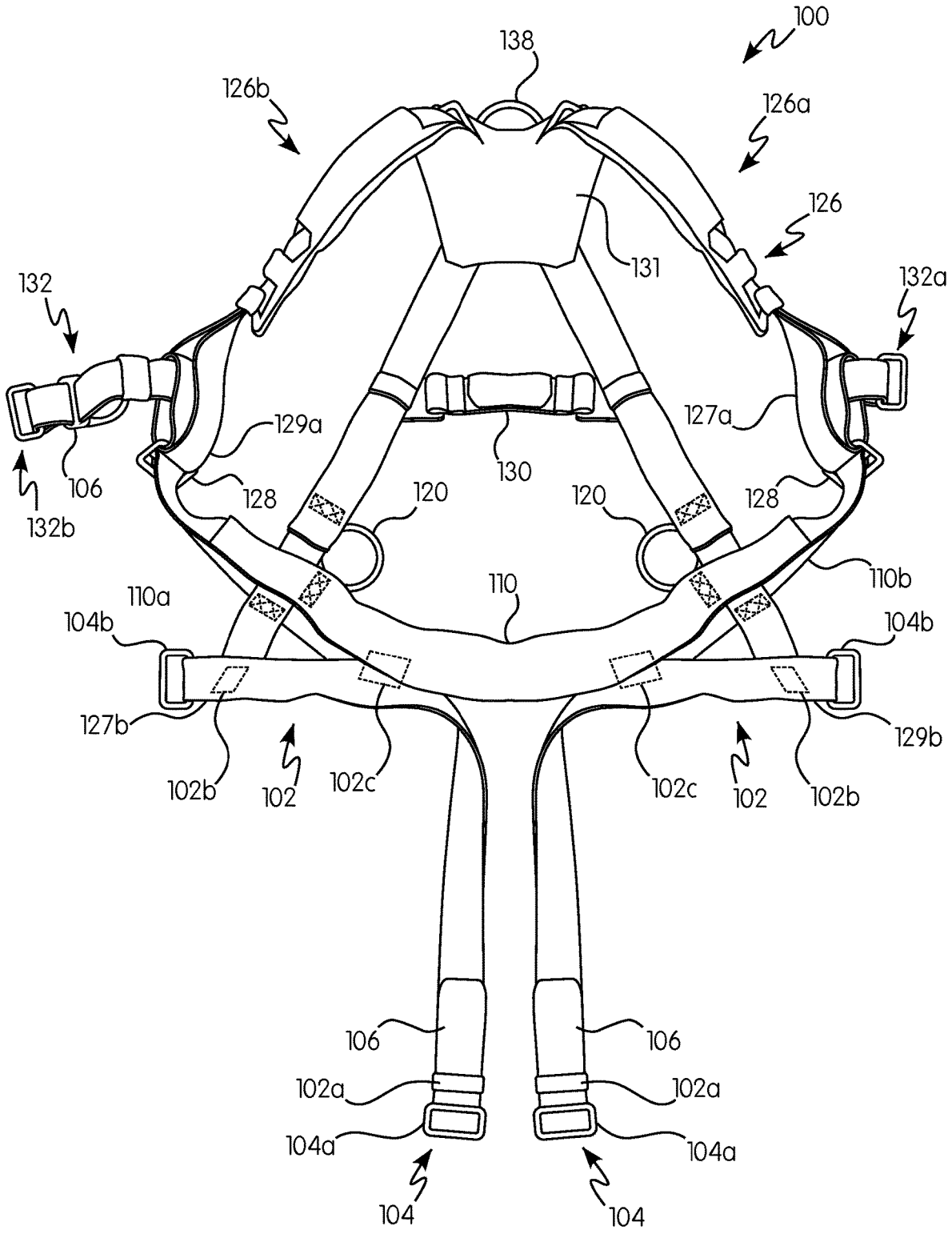
FIG. 1 is a front view of a harness in accordance with the principles of the present invention.

For purposes of the description hereinafter, the terms "end", "upper", "lower", "right", "left", "vertical", "horizontal", "top", "bottom", "lateral", "longitudinal" and derivatives thereof shall relate to the invention as it is oriented in the drawing figures. However, it is to be understood that the invention may assume various alternative variations and step sequences, except where expressly specified to the contrary. It is also to be understood that the specific devices and processes illustrated in the attached drawings, and described in the following specification, are simply exemplary embodiments of the invention. Hence, specific dimensions and other physical characteristics related to the embodiments disclosed herein are not to be considered as limiting.

As used in the specification and the claims, the singular form of "a", "an", and "the" include plural referents unless the context clearly dictates otherwise. As used in the specification and the claims, the term "end" refers to the extreme distal portion or the area near or adjacent that portion. Unless otherwise specified, the use of the term "attach", "attachable", and/or "attachment" includes a permanent, semi-permanent, removable, or adjustable attaching arrangement. As used in the specification and the claims, the term "integrated", when used with reference to an energy absorbing element and any portion of a harness, means that an energy absorbing element is formed as a separate component or arrangement and can be combined in, on, or with at least a portion of a separately formed harness (e.g., at least one strap or portion of a strap of the harness), such that the two components together constitute a whole. Therefore, the terms "therewith", "therein", and "thereon" are used interchangeably in the context of the present description. As used in the specification and the claims, the term "substantially parallel" means a relative angle as between two objects (if extended to theoretical intersection), such as elongated objects and including reference lines, that is from 0° to 5°, or from 0° to 3°, or from 0° to 2°, or from 0° to 1°, or from 0° to 0.5°, or from 0° to 0.25°, or from 0° to 0.1°, inclusive of the recited values.

As used in the specification and the claims, all ranges or ratios disclosed herein are to be understood to encompass any and all subranges or sub-ratios subsumed therein. For aspect or embodiment, a stated range or ratio of "1 to 10" should be considered to include any and all subranges between (and inclusive of) the minimum value of 1 and the maximum value of 10; that is, all sub-ranges or sub-ratios beginning with a minimum value of 1 or more and ending with a maximum value of 10 or less, such as but not limited to, 1 to 6.1, 3.5 to 7.8, and 5.5 to 10.

In various preferred and non-limiting embodiments or aspects, and with reference to FIGS. 1-3B, the present disclosure is directed to a harness 100 used in a fall protection system. As discussed herein, the harness 100 has at least one structural energy absorbing element integrated therewith and made from a tearable webbing material configured for absorbing energy during a fall event. In various preferred and non-limiting embodiments or aspects, the harness 100 may be used in combination with a supplementary energy absorbing element, such as a self-retracting lanyard (SRL) (not shown), to provide additional energy absorption during a fall event.

With continued reference to FIG. 1, the harness 100 has at least two leg straps 102 configured to attach around a user's legs below a user's groin area. When attached, the leg straps 102 loop around or encircle each of the user's legs. Each leg strap 102 has a first end 102*a* that is removably attachable to a second end 102*b* via a connector 104. In some preferred and non-limiting embodiments or aspects, the connector 104 may be a clip, a buckle, a mating arrangement, an actuatable structure, or the like. The connector 104 permits removable attachment of the first end 102*a* to the second end 102*b* of each leg strap 102. In this manner, the first and second ends 102*a*, 102*b* of the leg straps 102 are configured to be removably attached to each other and configured to be free floating when detached from each other. In some preferred and non-limiting embodiments or aspects, at least one connector 104 and/or the leg strap 102 may have at least one connection mechanism 106 configured for adjusting the length of each leg strap 102. In this manner, the at least one connection mechanism 106 adjusts a distance between the first end 102*a* and the second end 102*b* such that each leg strap 102 may be adjusted to fit comfortably around the user's legs. Each leg strap 102 may be formed from a substantially flat webbing material typically used in harness construction.

In various preferred and non-limiting embodiments or aspects of the present disclosure, the leg straps 102 (or, indeed, any of the straps in the harness 100) may be linear lengths of material, folded straps that form loops with the at least one connector 104 at the first end 102*a* and/or the second end 102*b*, or the like. For example, as shown in FIG. 1, the connector 104 may have a first portion 104*a* that is non-adjustably attached to the first end 102*a* of at least one leg strap 102, while a second portion 104*b* of the connector 104 is adjustably secured at the second end 102*b* of at least one leg strap 102 through a loop of the material that makes up the leg strap 102. Therefore, in such an arrangement, the second portion 104*b* of the connector 104 and the loop of material that makes up the leg strap 102 at the second end 102*b* defines the at least one connection mechanism 106 for adjusting a length of the leg strap 102. It should be noted that the position of the connection mechanism 106 may be reversed such that the second portion 104*b* of the connector 104 is provided on the first end 102*a* of the leg strap 102. At least one leg strap 102 may have padding (not shown) for increasing the user's comfort while wearing the harness 100.

With continued reference to FIG. 1, each leg strap 102 is connected to a belt strap 110 at a substantially intermediate portion 102*c* of the leg strap 102 between the first end 102*a* and the second end 102*b*. For example, each leg strap 102 may be connected to the belt strap 110. In some preferred and non-limiting embodiments or aspects, the substantially intermediate portion 102*c* of the leg strap 102 may be directly and non-movably connected to the belt strap 110, such as being sewn directly to the belt strap 110. In other preferred and non-limiting embodiments or aspects, the substantially intermediate portion 102*c* of each leg strap 102 may be connected to the rear end of the belt strap 110 by a connection strap (not shown) to allow the substantially intermediate portion 102*c* of the leg strap 102 to slidably move along a front portion of the leg strap 102. Accordingly, the position of the leg straps 102 may be adjusted relative to the belt strap 110 to increase the user's comfort while wearing the harness 100.

The belt strap 110 is configured to encircle at least a portion of the user's torso. The belt strap 110 has a first end 110*a* that is attached to a first portion of a shoulder strap 126 and a second end 110*b* that is attached to a second portion of the shoulder strap 126. The first end 110*a* and the second end 110*b* may be removably or non-removably attachable to the shoulder strap 126. In some embodiments or aspects, at least one of the first end 110*a* and the second end 110*b* may be attachable to the shoulder strap 126 via a connector similar to the connector 104 described herein with reference to the leg straps 102. In some preferred and non-limiting embodiments or aspects, the belt strap 110 may have at least one connection mechanism 106 configured for adjusting the length of the belt strap 110. In this manner, the at least one connection mechanism 106 adjusts a distance between the first end 110*a* and the second end 110*b* such that the belt strap 110 may be adjusted to fit comfortably around the user's torso. One or more handle connection members, and other handling and/or connectors 120 may be provided on at least a portion of the belt strap 110. The belt strap 110 may have padding (not shown) for increasing the user's comfort while wearing the harness 100. The belt strap 110 may be formed from a substantially flat webbing material typically used in harness construction.

With continued reference to FIG. 1, the harness 100 further has the shoulder strap 126 configured to extend over at least a portion of the user's shoulders. The shoulder strap 126 may have a first shoulder strap 126*a* and a second shoulder strap 126*b* arranged to overlap one another in an X-shaped configuration. In some preferred and non-limiting embodiments or aspects, the shoulder strap 126 may have at least one shoulder pad 131 having one or more openings through which the first shoulder strap 126*a* and the second shoulder strap 126*b* can be arranged to maintain the first shoulder strap 126*a* and the second shoulder strap 126*b* in the X-shaped configuration.

With specific reference to FIG. 1, the first shoulder strap 126*a* has a first end 127*a* that is connected to the second end 110*b* of the belt strap 110. The first end 127*a* of the first shoulder strap 126*a* may be removably or non-removably attachable to the second end 110*b* of the belt strap 110. In some preferred and non-limiting embodiments or aspects, the first end 127*a* of the first shoulder strap 126*a* may be attached to the second end 110*b* of the belt strap 110 via a connector similar to the connector 104 described herein with reference to the leg straps 102. The first shoulder strap 126*a* further has a second end 127*b* that is connected to one of the two leg straps 102. In some preferred and non-limiting embodiments or aspects, the second end 127*b* of the first shoulder strap 126*a* is connected to the leg strap 102 proximate to the second end 102*b* of the leg strap 102, such as by being sewn directly to the leg strap 102. The first shoulder strap 126*a* may have at least one loop 128 through which the first end 110*a* of the belt strap 110 may be passed. At least a portion of the first shoulder strap 126*a* may be formed from a substantially flat webbing material typically used in harness construction.

With continued reference to FIG. 1, the second shoulder strap 126*b* has a first end 129*a* that is connected to the first end 110*a* of the belt strap 110. The first end 129*a* of the second shoulder strap 126*b* may be removably or non-removably attachable to first end 110*a* of the belt strap 110. In some embodiments or aspects, the first end 129*a* of the second shoulder strap 126*b* may be attached to the first end 110*a* of the belt strap 110 via a connector similar to the connector 104 described herein with reference to the leg straps 102. The second shoulder strap 126*b* further has a second end 129*b* that is connected to the other of the two leg straps 102. In some preferred and non-limiting embodiments or aspects, the second end 129*b* of the second shoulder strap 126*b* is connected to the leg strap 102 proximate to the second end 102*b* of the leg strap 102, such as by being sewn directly to the leg strap 102. The second shoulder strap 126*b* may have at least one loop 128 through which the second end 110*b* of the belt strap 110 may be passed. At least a portion of the second shoulder strap 126*b* may be formed from a substantially flat webbing material typically used in harness construction.

As shown in FIG. 1, the harness 100 may have a back strap 130 connecting a substantially intermediate portion of the first shoulder strap 126*a* between its first end 127*a* and second end 127*b* with a substantially intermediate portion of the second shoulder strap 126*b* between its first end 129*a* and second end 129*b*. A position of the back strap 130 may be adjustable along a longitudinal direction of each the first shoulder strap 126*a* and the second shoulder strap 126*b*, such as by sliding the back strap 130 along the first shoulder strap 126*a* and/or the second shoulder strap 126*b*.

The harness 100 further may have a chest strap 132 having a first end 132*a* removably connectable to a second end 132*b*. The first end 132*a* of the chest strap 132 may be positioned proximate to the first end 127*a* of the first shoulder strap 126*a*, while the second end 132*b* of the chest strap 132 may be positioned proximate to the first end 129*a* of the second shoulder strap 126*b*. The first end 132*a* of the chest strap 132 is removably attachable to the second end 132*b* via a connector, similar to the connector 104 described herein with reference to the leg straps 102. In some preferred and non-limiting embodiments or aspects, the connector 104 may be a clip, a buckle, a mating arrangement, an actuatable structure, or the like. In this manner, the first and second ends 132*a*, 132*b* of the chest strap 132 are configured to be removably attached to each other and configured to be free floating when detached from each other. In some preferred and non-limiting embodiments or aspects, at least one of the back strap 130 and the chest strap 132 may have at least one connection mechanism, such as the connection mechanism 106 described herein with reference to the leg straps 102. The connection mechanism 106 is configured for adjusting the length of the back strap 130 and/or the chest strap 132. The back strap 130 and the chest strap 132 may be formed from a substantially flat webbing material typically used in harness construction.

Figure 2:
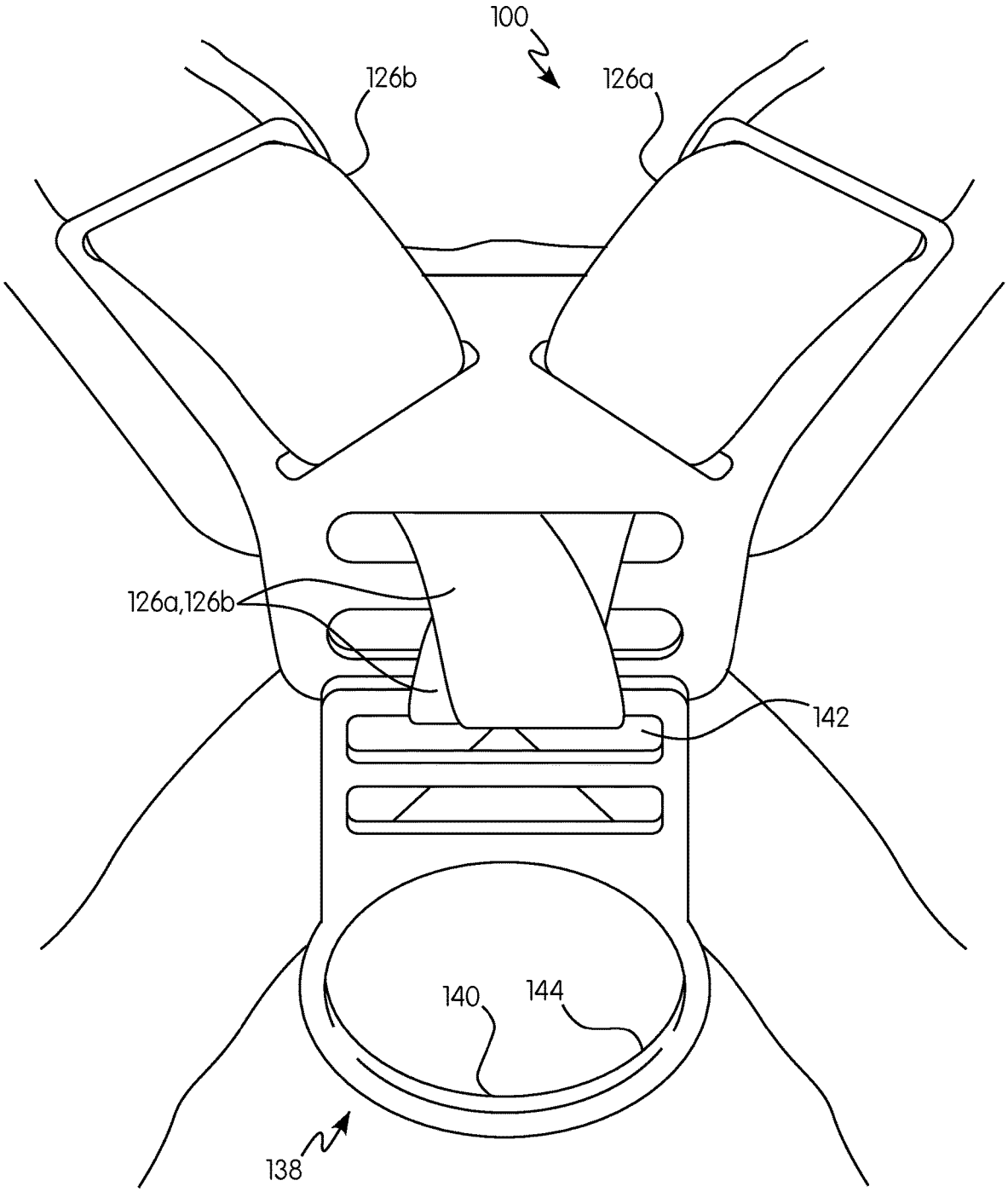
FIG. 2 is a detailed perspective view of a shoulder harness having an energy absorbing element in accordance with the principles of the present invention.

With reference to FIG. 2, the shoulder strap 126 has an anchor element, such as a D-ring 138, for connecting at least a portion of the shoulder strap 126 to a line connected to an anchor point. In some preferred and non-limiting embodiments or aspects, at least a portion of the first shoulder strap 126*a* and the second shoulder strap 126*b* is looped around or otherwise permanently attached to the D-ring 138. The D-ring 138 has a frame 140 defining at least one opening through which the first shoulder strap 126*a* and the second shoulder strap 126*b* may be looped around. In some preferred and non-limiting embodiments or aspects, the frame 140 of the D-ring 138 has a first opening 142 through which the first shoulder strap 126*a* and the second shoulder strap 126*b* extend. The D-ring further has a second opening 144 which may be used to secure the clip, such as a carabiner, of a lanyard or other rope or line between the harness 100 and the anchor point (or secure other items to the harness 100).

Figure 3A:
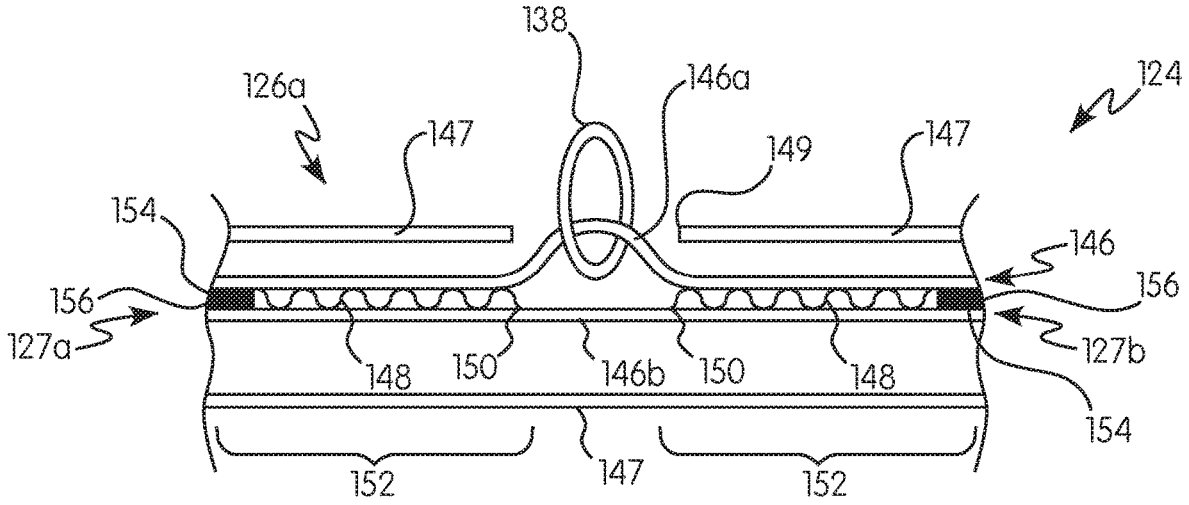
FIG. 3A is a schematic representation of the energy absorbing element in a first configuration.
Figure 3B:
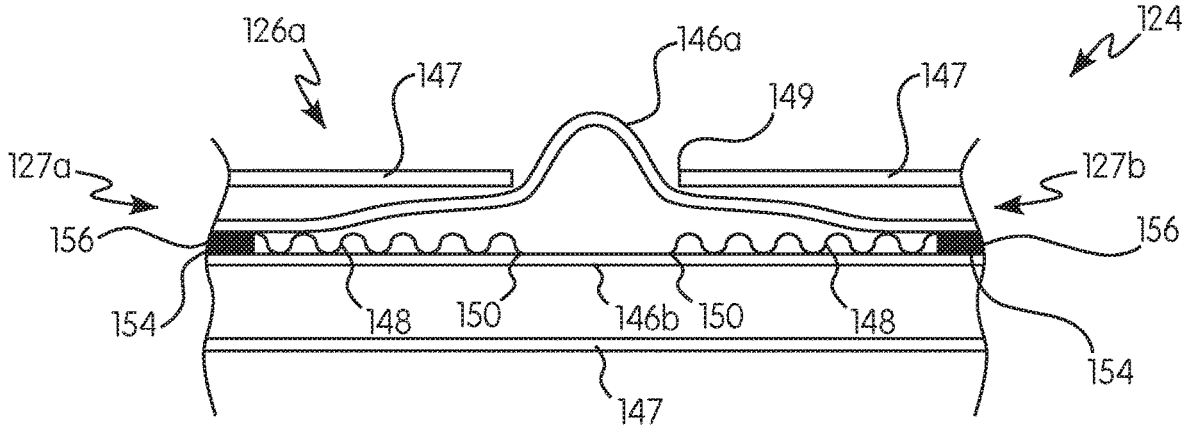
FIG. 3B is a schematic representation of the energy absorbing element in a second configuration.

In some preferred and non-limiting embodiments or aspects, the shoulder strap 126 has an energy absorbing element 101 integrated therewith (shown in FIGS. 3A-3B). In one preferred and non-limiting embodiment or aspect, at least one of the first shoulder strap 126*a* and the second shoulder strap 126*b* may be constructed from a tearable webbing material, such as an energy absorbing tear tape that is encased within a tubular webbing. In another preferred and non-limiting embodiment, and with reference to FIG. 3A, both the first shoulder strap 126*a* and the second shoulder strap 126*b* are made from a substantially flat webbing material 146 that is encased within a tubular webbing 147. The substantially flat webbing material 146 may be completely encased within the tubular webbing 147, except at a substantially intermediate portion of the first shoulder strap 126*a* and the second shoulder strap 126*b*, where at least a portion of the substantially flat webbing material 146 may be exposed (and exit) from the tubular webbing 147. Of course, this exposure or exit point or area may be at any point along the length of the first shoulder strap 126*a* and the second shoulder strap 126*b*.

In some preferred and non-limiting embodiments or aspects, the substantially flat webbing material 146 may be exposed from the tubular webbing 147 through an opening 149 in the tubular webbing 147 in an area where the substantially flat webbing material 146 is connected to the D-ring 138. As described herein, a first portion of the substantially flat webbing material 146 from each of the first shoulder strap 126*a* and the second shoulder strap 126*b* may be connected directly to the D-ring 138, while a second portion of the substantially flat webbing material 146 bypasses the D-ring 138. In this manner, the harness 100 does not differ externally from a conventional harness without the energy absorbing element 101, but incorporates the beneficial energy absorption element integrated into the harness 100.

With reference to FIGS. 3A-3B, the first shoulder strap 126*a* is illustrated. The second shoulder strap 126*b* is omitted for simplicity of illustration. While the illustration of the second shoulder strap 126*b* is omitted from FIGS. 3A-3B, construction and operation of the second shoulder strap 126*b* is identical to that of the first shoulder strap 126*a* in the embodiment or aspect where both shoulder straps 126*a*, 126*b* incorporate the tubular webbing 147 and/or energy absorbing element. Each of the first shoulder strap 126*a* and a second shoulder strap 126*b* may have the tubular webbing 147 arranged to overlap one another in an X-shaped configuration. The tubular webbing 147 of the first shoulder strap 126*a* may have a first end that corresponds with the first end 127*a* of the first shoulder strap 126*a* (shown in FIG. 1). The first end of the tubular webbing 147 may be connected to the second end 110*b* of the belt strap 110 in a removably or non-removably attachable manner. In some preferred and non-limiting embodiments or aspects, the first end of the tubular webbing 147 may be attachable to the second end 110*b* of the belt strap 110 via a connector similar to the connector 104 described herein with reference to the leg straps 102. The tubular webbing 147 further has a second end that corresponds to the second end 127*b* of the first shoulder strap 126*a* (shown in FIG. 1). The second end of the tubular webbing 147 may be connected to one of the two leg straps 102 in a removably or non-removably attachable manner. The tubular webbing 147 may be formed from webbing material that is woven into a tubular shape, or from flat webbing material wherein opposite lateral ends of the substantially flat webbing material are connected together to form the tubular shape of the tubular webbing 147.

In various examples, the tubular webbing 147 may have an internal diameter of about 0.5 inches to about 2.0 inches. In various embodiments or aspects, a longitudinal length of the tubular webbing 147 may be between about 24 inches to about 90 inches. The opening 149 in the tubular webbing 147 may be formed at a substantially intermediate point between the first end 127*a* and the second end 127*b* of the first shoulder strap 126*a* (and/or the second shoulder strap 126*b*). In some preferred and non-limiting embodiments or aspects, the opening 149 may be formed at a rear portion of the harness 100 at an upper portion of a user's back. In this manner, the opening 149 allows the substantially flat webbing material 146 to be exposed such that the substantially flat webbing material 146 may be connected to the D-ring 138. The opening 149 may be formed as a slit in the tubular webbing 147 having a length between about 0.5 inches to about 2.0 inches. In one preferred and non-limiting embodiment, and upon activation of the energy absorbing element, e.g., the flat webbing material 146, at least a portion of the energy absorbing element is configured to exit through the opening 149 of the tubular webbing 147 upon tearing, thereby facilitating the complete (if necessary) separation of the flat webbing material 146. Further, it is envisioned that the opening 149 may be reinforced wholly or partially around its edges to ensure that the tubular webbing 147 does not rip or tear during a fall event.

With continued reference to FIGS. 3A-3B, the substantially flat webbing material 146 of the first shoulder strap 126*a* has two webbing components 146*a*, 146*b* (which may be load-bearing webbing components) that are woven together by binder threads 148. In some embodiments or aspects, the webbing material 146 may have a plurality of load-bearing webbing components. The webbing components 146*a*, 146*b* may each be typically made from a two ply webbing material constructed from high tenacity polyester or nylon yarns. Each webbing component 146*a*, 146*b* may have a face ply and a back ply. The webbing components 146*a*, 146*b* may be superimposed over one another such that the back ply of one of the webbing components 146*a*, 146*b* is positioned over the face ply of the other of the webbing components 146*a*, 146*b*. The webbing components 146*a*, 146*b* and the binder threads 148 are woven together to constitute a single-piece webbing material, i.e., the first shoulder strap 126*a* and the second shoulder strap 126*b*. While the present disclosure describes binder threads 148 as a means of integrally bonding the webbing components 146*a*, 146*b* together, other suitable bonding means, such as hook-and-loop fasteners, adhesives, or other energy absorbing materials may also be used, either individually or in combination with the binder threads 148.

When the energy absorbing element is activated, such as during a fall event, the binder threads 148 are configured to be torn upon experiencing a force in excess of a predetermined force, thereby allowing the two webbing components 146*a*, 146*b* to tear apart from each other, such as shown in FIG. 3B. In some embodiments or aspects, the predetermined force (load) may be in the range of about 310 lbs to about 2,250 lbs. The binder threads 148 are configured to absorb energy (force) of a user falling during a fall event by fracturing (or tearing/separating) and allowing the webbing components 146*a*, 146*b* to separate from each other. The tearing of the binder threads 148 may be initiated by a minimum predetermined force (load), such as about 310 lbs. The tearing of the binder threads 148, and a consequent separation of the webbing components 146*a*, 146*b* continues as long as the force on the harness 100 exceeds the minimum predetermined force and ends when either (1) the webbing components 146*a*, 146*b* reach an ending point; or (2) the force reduces to a point below the minimum predetermined force. In various embodiments or aspects, the shoulder strap 126 may be configured to tear the webbing components 146*a*, 146*b* apart from each other due to breaking of the binder threads 148 at a constant force. The minimum predetermined force (load) required to break the binder threads 148 may be configurable by increasing or decreasing the density of the binder threads 148 per unit area, increasing or decreasing the width of the shoulder strap 126, increasing or decreasing the density of the binder threads 148 along a longitudinal length and/or a lateral length of the shoulder strap 126, and/or selecting a type of thread having specified strength characteristics.

As discussed above, and in another preferred and non-limiting embodiment or aspect, the webbing components 146*a*, 146*b* may be bound together by an adhesive, such as glue, that separates when reaching the minimum predetermined force or load. It is recognized that these adhesives may be specifically formulated to meet the separation requirements at the minimum predetermined force or load.

Figure 4A:
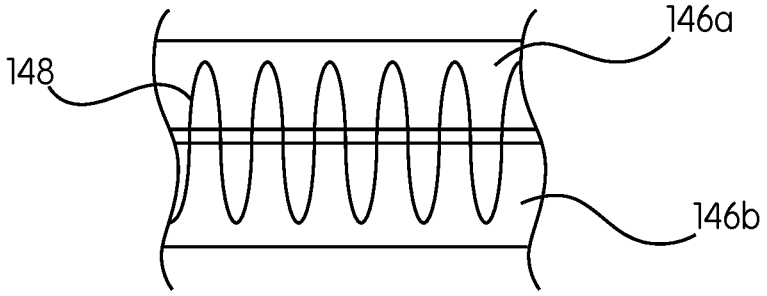
FIG. 4A is a side cross-sectional view of an energy absorbing element in accordance with the principles of the present invention.
Figure 4B:
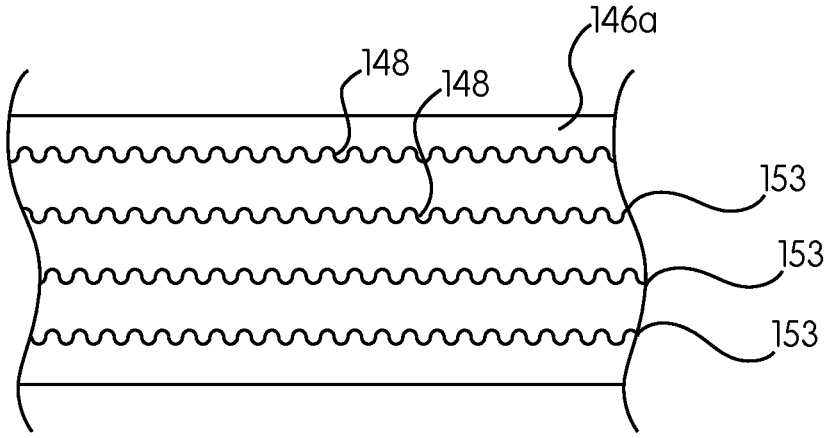
FIG. 4B is a top view of an energy absorbing element in accordance with the principles of the present invention.
Figure 4C:
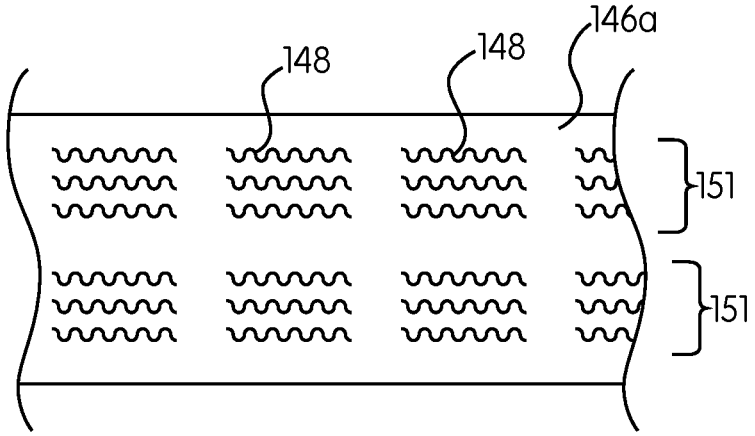
FIG. 4C is a top view of an energy absorbing element in accordance with the principles of the present invention.

With reference to FIG. 4A, the binder threads 148 may extend through at least a portion of a thickness of at least one of the webbing components 146*a*, 146*b*. For example, the binder threads 148 may extend between the face ply and the back ply of each of the webbing components 146*a*, 146*b*. In some embodiments or aspects, such as shown in FIG. 4A, the binder threads 148 extend though the entire thickness of each of the webbing components 146*a*, 146*b*. With reference to FIG. 4B, the binder threads 148 may be woven in two or more rows 153 extending along a longitudinal length and/or a lateral length of the webbing components 146*a*, 146*b*. In various preferred and non-limiting embodiments or aspects, the rows 153 may be substantially parallel to each other, or intersect at least once with each other along the longitudinal length and/or the lateral length of the webbing components 146*a*, 146*b*. With reference to FIG. 4C, the binder threads 148 may be arranged in a plurality of thread groups 151 arranged in a pattern on the webbing components 146*a*, 146*b*. In some preferred and non-limiting embodiments or aspects, the density of thread groups 151 may be constant along the longitudinal length and/or the lateral length of the webbing components 146*a*, 146*b*. In this manner, the webbing components 146*a*, 146*b* will separate from one another due to breaking of the binder threads 148 at a constant rate at a given force that exceeds the minimum predetermined force. In other preferred and non-limiting embodiments or aspects, the density of thread groups 151 may vary along the longitudinal length and/or the lateral length of the webbing components 146*a*, 146*b*, such as by increasing or decreasing the density of the thread groups 151. Accordingly, the webbing components 146*a*, 146*a* will separate from one another due to breaking of the binder threads 148 at an increasing or decreasing rate at a given force that exceeds the minimum predetermined force. The arrangement of the thread groups 151 may be selected to optimize the tear-away force required to break the binder threads 148 (or adhesive) during separation of the webbing components 146*a*, 146*b* from each other. In various preferred and non-limiting embodiments or aspects, the binder threads 148 extend continuously between the webbing components 146*a*, 146*b* in a sinusoidal manner. The binder threads 148 may be made from high tenacity polyester yarns, nylon, or other suitable materials. The tensile strength of the binder threads 148 is desirably selected to be less than that of the webbing components 146*a*, 146*b* to allow the binder threads 148 to tear without tearing the webbing components 146*a*, 146*b*.

With reference to FIG. 3A, the first shoulder strap 126*a* may have a starting tear point 150 at which the two webbing components 146*a*, 146*b* are not bound by the binder threads 148. The starting tear point 150 may be defined at a substantially intermediate portion of the first shoulder strap 126*a* between the first end 127*a* and the second end 127*b*. After the starting tear point 150, the webbing components 146*a*, 146*b* are integrally woven together. With reference to FIG. 3B, as the user falls during a fall event, the binder threads 148 start to fracture (or tear) at the starting tear point 150 and continue tearing along the longitudinal length of an energy absorbing area 152 of the shoulder strap 126 that ties the webbing components 146*a*, 146*b* with the binder threads 148. The binder threads 148 are configured to tear successively along the longitudinal length of the bound absorbing area 152 beginning from the starting tear point 150. The successive tearing of the binder threads 148 absorbs energy of the fall, thereby safely decelerating the user and reducing the shock transferred to the user's body as the user's weight is borne by the harness. Further, at least a portion of the webbing components 146*a*, 146*b* exit from the tubular webbing 147 through the opening 149.

With continued reference to FIG. 3B, the first shoulder strap 126*a* may have an ending tear point 154 at an end of the energy absorbing area 152. The ending tear point 154 may have a reinforced area 156, such as by additional stitching, to prevent further tearing of the webbing components 146*a*, 146*b*. Once activated, the two webbing components 146*a*, 146*b* support the user's weight, such as with one of the webbing components 146*a*, 146*b* being connected to the D-ring 138, and the other of the two webbing components 146*a*, 146*b* supporting the user's shoulders. The tearing of the two webbing components 146*a*, 146*b* due to breaking of the binder threads 148 may end prior to the ending tear point 154 if the force on the harness is reduced below the minimum predetermined force necessary to tear the binder threads 148.

The shoulder strap 126 having an energy absorbing element integrated therewith, such as the two webbing components 146*a*, 146*b* bound by binding threads 148, reduces the risk of misuse, especially in leading edge applications where the user may incorrectly attach an integrated energy absorbing element to a conventional harness. A harness 100 having such a shoulder strap 126 eliminates the need for a structural back-up strap as the tear tape maintains the static strength of structural webbing at full elongation (end of deployment shown in FIG. 5C). In this manner, the harness 100 does not differ externally from a conventional harness without the energy absorbing element, but incorporates the beneficial energy absorption element integrated into the harness 100.

Although the invention has been described in detail for the purpose of illustration based on what is currently considered to be the most practical and preferred embodiments, it is to be understood that such detail is solely for that purpose and that the invention is not limited to the disclosed embodiments, but, on the contrary, is intended to cover modifications and equivalent arrangements that are within the spirit and scope of the appended claims. For example, it is to be understood that the present invention contemplates that, to the extent possible, one or more features of any embodiment can be combined with one or more features of any other embodiment.

What is claimed is:

1. A wearable harness having a plurality of straps comprising:

a first shoulder strap and a second shoulder strap, wherein at least one of the first shoulder strap and the second shoulder strap is made from a tubular webbing; and an energy absorbing element integrated with the tubular webbing of at least one of the first shoulder strap and the second shoulder strap, wherein the energy absorbing element comprises at least two bound webbing components at least partially encased within the tubular webbing, wherein the at least two bound webbing components have an unbound, starting tear point exposed from the tubular webbing through an opening in the tubular webbing between a first terminal end and a second terminal end of the tubular webbing, wherein the at least two bound webbing components are configured to tear from one another when the first shoulder strap and the second shoulder strap are subjected to a force that exceeds a predetermined threshold during a fall event, and wherein a connector element is connected to the at least two bound webbing components at the unbound, starting tear point.

2. The harness of claim 1, wherein at least a portion of the energy absorbing element is configured to exit through the opening of the tubular webbing upon tearing.

3. The harness of claim 1, wherein the tubular webbing comprises a substantially flat webbing material having opposing lateral ends connected to one another to define a tubular shape.

4. The harness of claim 1, wherein the at least two bound webbing components are bound by a plurality of binder threads.

5. The harness of claim 4, wherein the plurality of binder threads are configured to tear successively in a longitudinal direction of at least one of the first shoulder strap and the second shoulder strap when the at least one of the first shoulder strap and the second shoulder strap is subjected to the force that exceeds the predetermined threshold.

6. The harness of claim 4, wherein the plurality of binder threads extend through at least a portion of a thickness of the at least two webbing components.

7. The harness of claim 4, wherein the plurality of binder threads are arranged in two or more substantially parallel or intersecting rows extending along a longitudinal length or a lateral length of the webbing components.

8. The harness of claim 4, wherein the plurality of binder threads are arranged in two or more thread groups arranged in a pattern and spaced apart from each other along a longitudinal length or a lateral length of the webbing components.

9. The harness of claim 1, wherein the predetermined threshold is in a range of about 310 lbs to about 2,250 lbs.

10. The harness of claim 1, wherein the at least two bound webbing components are bound together by an adhesive.

11. The harness of claim 1, wherein the first shoulder strap and the second shoulder strap have an ending tear point having a reinforced area configured to prevent separation of the at least two bound webbing components.

12. The harness of claim 1, wherein the energy absorbing element is located on an energy absorbing area at a rear portion of at least one of the first shoulder strap and the second shoulder strap.

13. A fall protection harness removably wearable by a user, the harness having a plurality of straps comprising:

a first shoulder strap and a second shoulder strap is made from a tubular webbing, wherein at least one of the first shoulder strap and the second shoulder strap have an energy absorbing element integrated with the tubular webbing, the energy absorbing element comprising at least two bound webbing components at least partially encased within the tubular webbing, the at least two bound webbing components bound together by a plurality of binder threads configured to tear successively in a longitudinal direction of the first shoulder strap and the second shoulder strap when the first shoulder strap and the second shoulder strap are subjected to a predetermined force during a fall event, wherein the at least two bound webbing components have an unbound, starting tear point exposed from the tubular webbing through an opening in the tubular webbing between a first terminal end and a second terminal end of the tubular webbing, and wherein a connector element is connected to the at least two bound webbing components at the unbound, starting tear point.

14. The harness of claim 13, wherein the energy absorbing element is located on an area at a rear portion of at least one of the first shoulder strap and the second shoulder strap.

15. In a harness removably attachable to a body of a user and having at least one strap comprising:

an energy absorbing element integrated with a tubular webbing defining the at least one strap, wherein the energy absorbing element comprises at least two bound webbing components at least partially encased within the tubular webbing of the at least one strap, wherein the at least two bound webbing components have an unbound, starting tear point exposed from the tubular webbing through an opening in the tubular webbing between a first terminal end and a second terminal end of the tubular webbing, wherein the at least two bound webbing components are configured to tear from one another when the at least one strap is subjected to a force that exceeds a predetermined threshold during a fall event, and wherein a connector element is connected to the at least two bound webbing components at the unbound, starting tear point.

* * * * *